US007272339B2

(12) United States Patent
Tsuzuki et al.

(10) Patent No.: US 7,272,339 B2
(45) Date of Patent: Sep. 18, 2007

(54) PROCESS CARTRIDGE INCLUDING FIRST AND SECOND FRAMES AND SEPARATING MEMBER MOVING THE SECOND FRAME TO A SEPARATED POSITION AND IMAGE FORMING APPARATUS DETACHABLY MOUNTING THE CARTRIDGE

(75) Inventors: Masatomo Tsuzuki, Odawara (JP); Kanji Yokomori, Odawara (JP); Susumu Nittani, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 11/137,577

(22) Filed: May 26, 2005

(65) Prior Publication Data

US 2006/0245784 A1 Nov. 2, 2006

(30) Foreign Application Priority Data

Apr. 27, 2005 (JP) ..... 2005-129494

(51) Int. Cl.
*G03G 21/16* (2006.01)

(52) U.S. Cl. ..... 399/111; 399/119

(58) Field of Classification Search ..... 399/111, 399/119

See application file for complete search history.

(56) References Cited

U.S. PATENT DOCUMENTS

| | | | | |
|---|---|---|---|---|
| 5,839,028 | A | 11/1998 | Nomura et al. | 399/109 |
| 5,878,309 | A | 3/1999 | Nomura et al. | 399/111 |
| 5,940,657 | A | 8/1999 | Yokomori et al. | 399/119 |
| 5,943,528 | A | 8/1999 | Akutsu et al. | 399/110 |
| 5,950,049 | A | 9/1999 | Yokomori et al. | 399/119 |
| 5,953,562 | A | 9/1999 | Kawaguchi et al. | 399/117 |
| 6,029,031 | A | 2/2000 | Yokomori et al. | 399/109 |
| 6,055,406 | A | 4/2000 | Kawai et al. | 399/360 |
| 6,064,843 | A | 5/2000 | Isobe et al. | 399/111 |
| 6,072,969 | A | 6/2000 | Yokomori et al. | 399/119 |
| 6,215,969 | B1 | 4/2001 | Nomura et al. | 399/111 |
| 6,233,421 | B1 * | 5/2001 | Wang et al. | 399/262 |
| 6,236,821 | B1 | 5/2001 | Yokoyama et al. | 399/113 |
| 6,345,164 | B1 | 2/2002 | Yokomori et al. | 399/119 |
| 6,381,430 | B1 | 4/2002 | Yokomori et al. | 399/119 |
| 6,459,869 | B2 | 10/2002 | Nittani et al. | 399/111 |
| 6,463,232 | B1 | 10/2002 | Kawai et al. | 399/111 |
| 6,463,234 | B2 | 10/2002 | Arimitsu et al. | 399/113 |
| 6,480,687 | B1 | 11/2002 | Kawai et al. | 399/111 |
| 6,681,088 | B2 | 1/2004 | Kanno et al. | 399/111 |
| 6,684,041 | B2 | 1/2004 | Yokomori et al. | 399/167 |
| 6,738,588 | B2 | 5/2004 | Yokomori et al. | 399/111 |
| 6,834,171 | B2 | 12/2004 | Nittani et al. | 399/103 |

(Continued)

FOREIGN PATENT DOCUMENTS

JP 05188667 A * 7/1993

(Continued)

*Primary Examiner*—Quana Grainger
(74) *Attorney, Agent, or Firm*—Fitzpatrick, Cella, Harper & Scinto

(57) ABSTRACT

A process cartridge and an image forming apparatus which can stably keep a developing separated state for a long period by a compact construction, and in which when a separating member has been mounted on the process cartridge, the separating member is supported in a center impeller fashion by one frame, and the other frame is supported by a portion therebetween to thereby keep the developing separated state.

11 Claims, 13 Drawing Sheets

U.S. PATENT DOCUMENTS

| | | | | |
|---|---|---|---|---|
| 6,934,489 | B2 | 8/2005 | Yokomori et al. | 399/111 |
| 6,980,758 | B2 | 12/2005 | Murayama et al. | 399/111 |
| 7,016,626 | B2 | 3/2006 | Yokomori et al. | 399/117 |
| 7,024,137 | B2 | 4/2006 | Nittani et al. | 399/222 |
| 7,027,756 | B2 | 4/2006 | Hoshi et al. | 399/111 |
| 7,039,339 | B2 | 5/2006 | Yokomori et al. | 399/111 |
| 7,072,603 | B2 | 7/2006 | Tsuzuki et al. | 399/111 |
| 7,088,938 | B2 | 8/2006 | Hashimoto et al. | 399/103 |
| 7,088,939 | B2 | 8/2006 | Maeshima et al. | 399/111 |
| 2003/0185587 | A1 | 10/2003 | Kawai et al. | 399/111 |
| 2005/0115043 | A1 | 6/2005 | Maeshima et al. | 29/402.08 |
| 2005/0117934 | A1 | 6/2005 | Murayama et al. | 399/111 |
| 2005/0260011 | A1 | 11/2005 | Murayama et al. | 399/111 |
| 2006/0013618 | A1 | 1/2006 | Nittani et al. | 399/222 |
| 2006/0177231 | A1 | 8/2006 | Mori et al. | 399/12 |

FOREIGN PATENT DOCUMENTS

| | | | | |
|---|---|---|---|---|
| JP | 11015354 | A | * | 1/1999 |
| JP | 2001201914 | A | * | 7/2001 |

* cited by examiner

PROCESS CARTRIDGE INCLUDING FIRST AND SECOND FRAMES AND SEPARATING MEMBER MOVING THE SECOND FRAME TO A SEPARATED POSITION AND IMAGE FORMING APPARATUS DETACHABLY MOUNTING THE CARTRIDGE

BACKGROUND OF THE INVENTION

1. Field of the Invention

The invention relates to an electrophotographic image forming apparatus and a process cartridge detachably mountable on the electrophotographic image forming apparatus.

Here, the electrophotographic image forming apparatus is an apparatus for recording an image on a recording medium by the use of an electrophotographic image forming process, and this term covers, for example, an electrophotographic copying machine, an electrophotographic printer (such as, for example, a laser beam printer or an LED printer), a facsimile apparatus and a word processor or the like.

Also, the process cartridge refers to at least one of charging means, developing means and cleaning means and an electrophotographic image bearing member integrally made into a cartridge, which is made detachably mountable on a main body of an image forming apparatus.

2. Description of the Related Art

An electrophotographic image forming apparatus such as a copying machine, a laser beam printer or a facsimile apparatus effects selective exposure on an electrophotographic photosensitive drum which is an image bearing member uniformly charged by a charging device to thereby form an electrostatic latent image thereon. This electrostatic latent image is then developed as a toner image by a toner being caused to adhere thereto by a developing device, whereafter this toner image is transferred to a recording material such as paper to thereby form an image. The image bearing member after the transfer of the toner image has any residual toner on its surface removed by a cleaning device, and is used for the next image forming operation.

In recent years, there are known the image bearing member, the charging device, the developing device, the cleaning device, etc. integrally incorporated into a cartridge container and made into a process cartridge. This process cartridge is designed to be detachably mountable on a main body of an image forming apparatus. Consequently, a user can mount it on the image forming apparatus main body to thereby simply effect the supply of the toner and the interchange of the image bearing member by himself, thus achieving the ease of maintenance.

Further in recent years, there has also been devised an image forming apparatus for forming a multi-color image, and a process cartridge for use in such multi-color image forming apparatus has also been put into practical use.

As developing means in the above-described process cartridge, there are generally known two types, i.e., a contact developing type which effects development with a developer carrying member brought into contact with the image bearing member, and a non-contact developing type which effects development with a developer carrying member spaced apart by a predetermined gap from the image bearing member.

The developing means of the above-described contact type, however, if left in contact with the image bearing member for a long period, has sometimes affected an image with that portion of the developing means which contacts with the image bearing member being deformed. Also on the surface of the image bearing member, the image bearing member and the developing means frictionally contact each other due to the vibration or the like during the transportation of the process cartridge, and a hysteresis remains as a development memory, and this has sometimes affected an image.

As means for avoiding the above-noted problems, there have heretofore been proposed an image forming apparatus and a process cartridge of a construction provided with a mechanism for separating the image bearing member and the developing means from each other during non-use such as shipping or the long-term stoppage of use (U.S. Patent Publication No. 2003/0185587). The conventional separating member is of a construction which grasps the frame of the process cartridge against a developing biasing member to thereby separate the developing means from the image bearing member.

The present invention is further development of the conventional art.

SUMMARY OF THE INVENTION

It is an object of the present invention to provide a process cartridge and an image forming apparatus in which a developing roller can be stably separated from an electrophotographic photosensitive drum.

It is another object of the present invention to provide a process cartridge and an image forming apparatus in which a developing roller can be reliably and stably separated from an electrophotographic photosensitive drum with the lapse of time.

It is another object of the present invention to provide a process cartridge detachably mountable on a main body of an electrophotographic image forming apparatus. The process cartridge has an electrophotographic photosensitive drum, a developing roller for contacting the electrophotographic photosensitive drum to thereby develop an electrostatic latent image formed on the electrophotographic photosensitive drum, a first frame for rotatably supporting the electrophotographic photosensitive drum, a second frame for rotatably supporting the developing roller, the second frame being rotatably connected to the first frame and capable of assuming a contact position in which the developing roller contacts the electrophotographic photosensitive drum, and a separated position in which the developing roller is separated from the electrophotographic photosensitive drum, and a separating member for moving the second frame to the separated position when it comes into engagement with the first frame and the second frame from the longitudinal direction of the process cartridge, the separating member being engaged with a first supporting portion and a second supporting portion provided in the first frame, and a third supporting portion provided in the second frame and located between the first supporting portion and the second supporting portion in the longitudinal direction.

It is another object of the present invention to provide a process cartridge detachably mountable on a main body of an electrophotographic image forming apparatus. The process cartridge has an electrophotographic photosensitive drum, a developing roller for contacting the electrophotographic photosensitive drum to thereby develop an electrostatic latent image formed on the electrophotographic photosensitive drum, a first frame for rotatably supporting the electrophotographic photosensitive drum, a second frame for rotatably supporting the developing roller, the second frame being rotatably connected to the first frame and capable of assuming a contact position in which the developing roller contacts the electrophotographic photosensitive drum, and a separated position in which the developing roller is separated from the electrophotographic photosensitive drum, and a separating member for moving the second frame to the separated position when it comes into engagement with the first frame and the second frame from the longitudinal direction of the process cartridge, the separating member being engaged with a first supporting portion and a second supporting portion provided in the second frame, and a third supporting portion provided in the first frame and located between the first supporting portion and the second supporting portion in the longitudinal direction.

It is another object of the present invention to provide an electrophotographic image forming apparatus on which a process cartridge is detachably mountable and which forms an image on a recording medium. The electrophotographic image forming apparatus has (i) a mounting member for detachably mounting the process cartridge. The process cartridge has an electrophotographic photosensitive drum, a developing roller for contacting the electrophotographic photosensitive drum to thereby develop an electrostatic latent image formed on the electrophotographic photosensitive drum, a first frame for rotatably supporting the electrophotographic photosensitive drum, a second frame for rotatably supporting the developing roller, the second frame being rotatably connected to the first frame and capable of assuming a contact position in which the developing roller contacts the electrophotographic photosensitive drum, and a separated position in which the developing roller is separated from the electrophotographic photosensitive drum, and a separating member for moving the second frame to the separated position when it comes into engagement with the first frame and the second frame from the longitudinal direction of the process cartridge, the separating member being engaged with a first supporting portion and a second supporting portion provided in the first frame, and a third supporting member provided in the second frame and located between the first supporting portion and the second supporting portion in the longitudinal direction. The apparatus also comprises (ii) conveying means for conveying the recording medium.

It is another object of the present invention to provide an electrophotographic image forming apparatus on which a process cartridge is detachably mountable and which forms an image on a recording medium. The electrophotographic image forming apparatus has (i) a mounting member for detachably mounting the process cartridge. The process cartridge has an electrophotographic photosensitive drum, a developing roller for contacting the electrophotographic photosensitive drum to thereby develop an electrostatic latent image formed on the electrophotographic photosensitive drum, a first frame for rotatably supporting the electrophotographic photosensitive drum, a second frame for rotatably supporting the developing roller, the second frame being rotatably connected to the first frame and capable of assuming a contact position in which the developing roller contacts the electrophotographic photosensitive drum, and a separated position in which the developing roller is separated from the electrophotographic photosensitive drum, and a separating member for moving the second frame to the separated position when it comes into engagement with the first frame and the second frame from the longitudinal direction of the process cartridge, the separating member being engaged with a first supporting portion and a second supporting portion provided in the second frame, and a third supporting portion provided in the first frame and located between the first supporting portion and the second supporting portion in the longitudinal direction. The apparatus also comprises (ii) conveying means for conveying the recording medium.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS (About an Entire Image Forming Apparatus)

Some embodiments to which the present invention can be applied will hereinafter be described with reference to the drawings. However, the dimensions, materials, shapes and relative disposition of constituent parts described in these embodiments, unless particularly specified, are not intended to restrict the scope of this invention thereto. Also, the materials, shapes, etc. of members once described in the following description, unless particularly newly described, are similar to those described at first.

[Description of the Whole of the Image Forming Apparatus]

Figure 1:
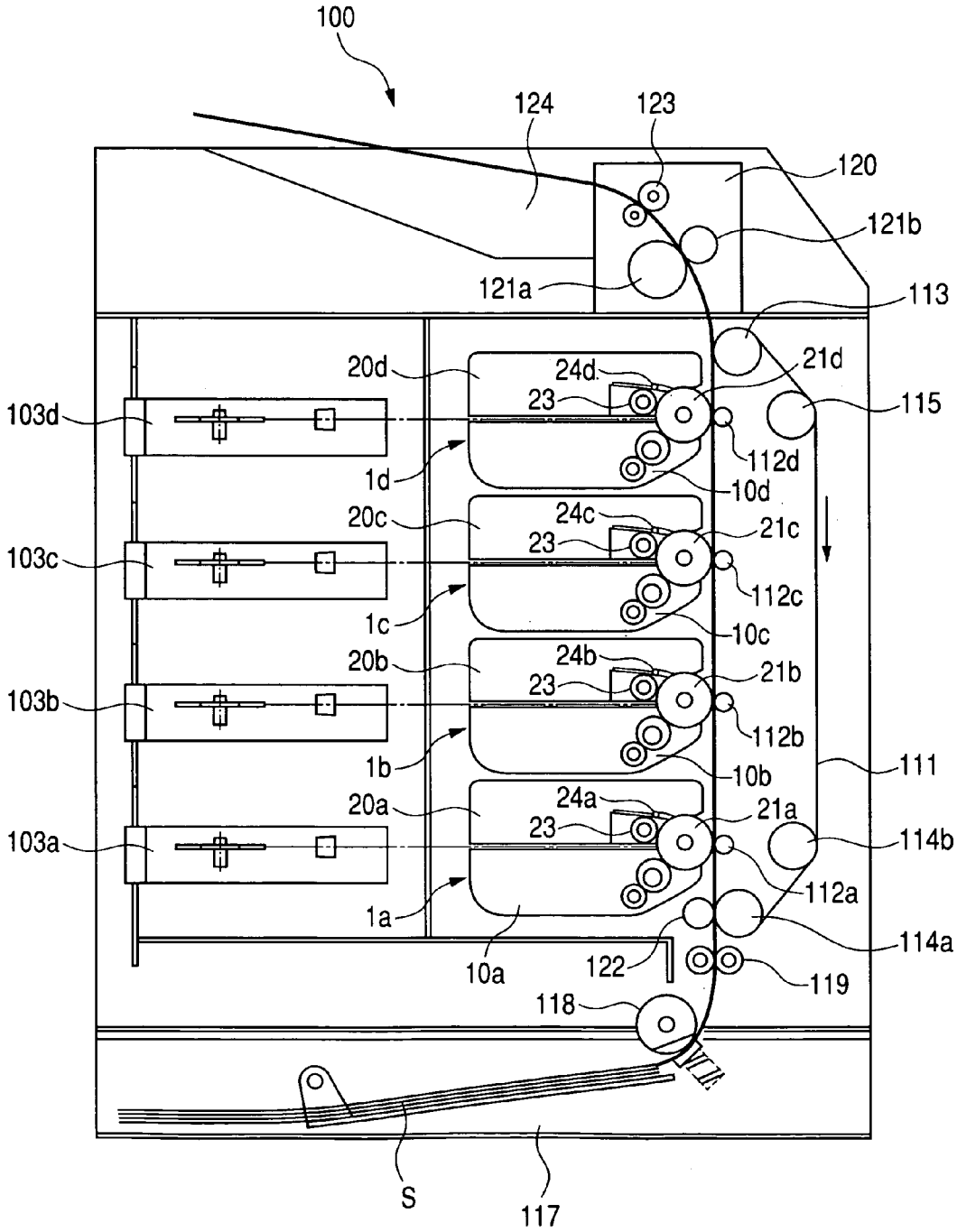
FIG. 1 is a typical cross-sectional view of an image forming apparatus according to an embodiment of the present invention.

The general construction of an electrophotographic image forming apparatus 100 (hereinafter referred to as the image forming apparatus 100) will first be described together with the image forming operation thereof with reference to FIG. 1. FIG. 1 is a schematic view showing a state in which a process cartridge 1 (hereinafter referred to as the cartridge 1) which is the present embodiment is mounted on the image forming apparatus 100.

As shown in FIG. 1, the image forming apparatus 100 according to the present embodiment has a mounting portion (not shown) for mounting for cartridges 1 (1*a*, 1*b*, 1*c*, 1*d*) juxtaposed in a vertical direction. The cartridges 1 for forming yellow, magenta, cyan and black toner images are mounted on the image forming apparatus 100 in the named order from below. The cartridges 1 differ in the colors of formed toner images from one another, but are of the same construction.

Laser beam images based on image information are applied from optical means 103 (103*a*, 103*b*, 103*c*, 103*d*) to the respective cartridges 1. Then, electrostatic latent images are formed on photosensitive drums 21 (21*a*, 21*b*, 21*c*, 21*d*) which are drum-shaped electrophotographic photosensitive members. These electrostatic latent images are developed into toner images by a developing roller 11 or the like. In synchronism with the formation of these toner images, a recording medium S such as recording paper or an OHP sheet is conveyed from a cassette 117 by conveying means comprising a separating and feeding roller 118, conveying rollers 119 and a conveying belt 111.

The conveying belt 111 is a film-like member circulatively moved so as to be opposed to and contact with all of the photosensitive drums 21, and is passed over two rollers, i.e., a drive roller 113, driven rollers 114*a*, 114*b* and a tension roller 115 and is rotated in the direction indicated by the arrow in FIG. 1. The recording medium S is conveyed to a transferring position by the conveying belt 111. Then, the toner images formed on the photosensitive drums are transferred to the recording medium S by a bias being applied to transfer rollers 112 (112*a*, 112*b*, 112*c*, 112*d*) as transferring means, and the recording medium S is conveyed to fixing means 120. This fixing means 120 has a drive roller 121*a* and a fixing roller 121*b* containing a heater therein, and heat and pressure are applied to the recording medium S being conveyed through the fixing means 120, whereby the toner images are fixed on the recording medium S. Then, this recording medium S is discharged to a discharging portion 124 by a pair of discharging rollers 123.

Embodiment 1

[Process Cartridge]

Figure 2:
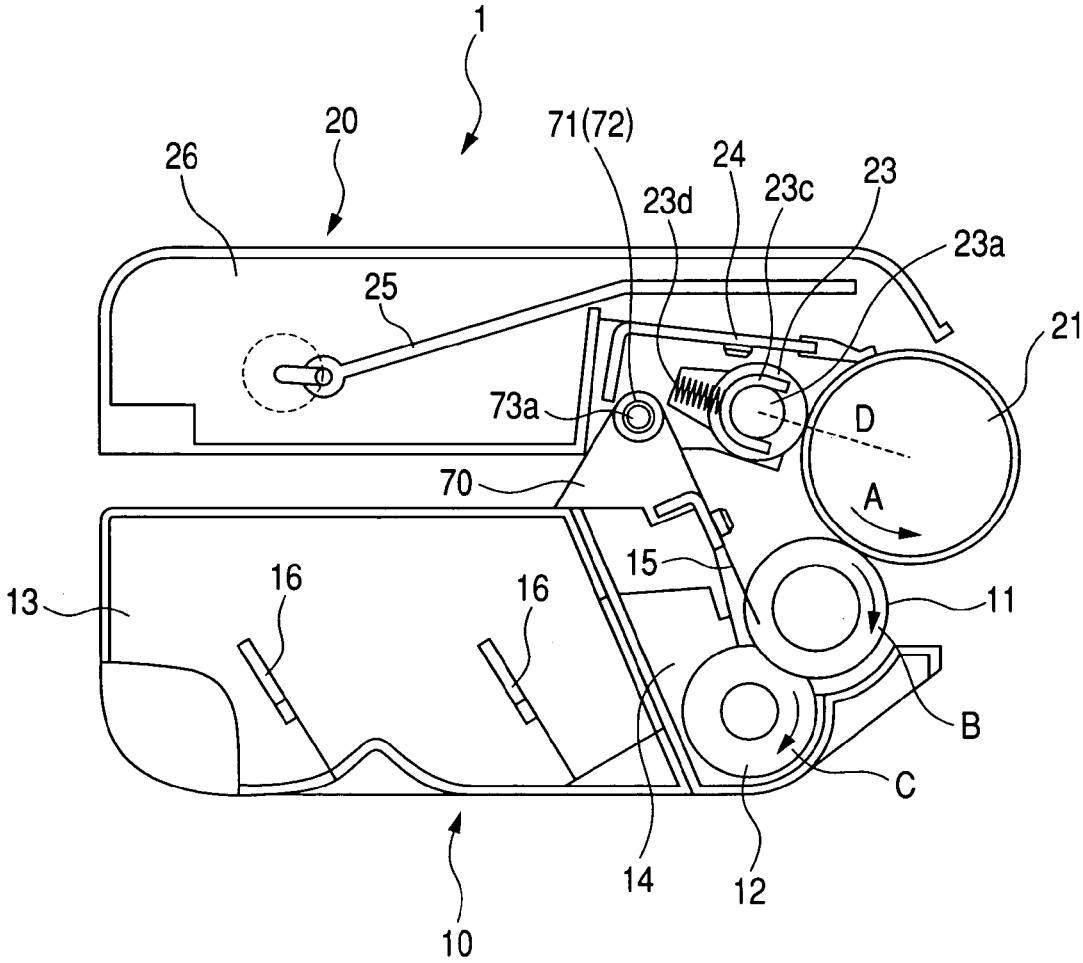
FIG. 2 is a typical cross-sectional view of a process cartridge according to an embodiment of the present invention.

The construction of the process cartridge 1 to which the present invention can be applied will now be described with reference to FIG. 2. The cartridge 1 is divided into a drum unit 20 which is a first frame provided with the photosensitive drum 21, a charging roller 23 and a cleaning blade 24, and a developing unit 10 which is a second frame having developing means for developing the electrostatic latent image on the photosensitive drum 21.

[Drum Unit]

The construction of the drum unit 20 will now be described with reference to FIG. 2. The photosensitive drum 21 is rotatably mounted on the drum unit 20. The photosensitive drum 21 is constituted by an aluminum cylinder having an organic photoconductive material layer applied to the outer peripheral surface thereof. On the periphery of the photosensitive drum 21, there are disposed the charging roller 23 which is a primary charging member for uniformly charging the surface of the photosensitive drum 21, and a cleaning blade 24 (hereinafter referred to as the blade 24) for removing any developer (toner) residual on the photosensitive drum 21. Further, the residual toner removed from the surface of the photosensitive drum 21 by the blade 24 is sequentially conveyed to a waste toner chamber 26 by a toner conveying mechanism 25. Then, the driving force of a drive motor (not shown) is transmitted, whereby the photosensitive drum 21 is rotated in the direction indicated by the arrow A (counter-clockwise direction) in accordance with an image forming operation.

[Developing Unit]

The construction of the developing unit 10 will now be described with reference to FIG. 2. The developing unit 10 is comprised of the developing roller 11 being in contact with the photosensitive drum 21 and rotated in the direction indicated by the arrow B, a toner container 13 in which the toner is contained, and a developing container 14 which is a developing portion. On the peripheral surface of the developing roller 11, there are disposed a toner supplying roller 12 being in contact with the developing roller 11 and rotated in the direction indicated by the arrow C, and a developing blade 15. Further, in the toner container 13, there is provided a toner agitating mechanism 16 for agitating the toner and conveying the toner to the toner supplying roller 12.

[Supporting of the Developing Unit]

Figure 3:
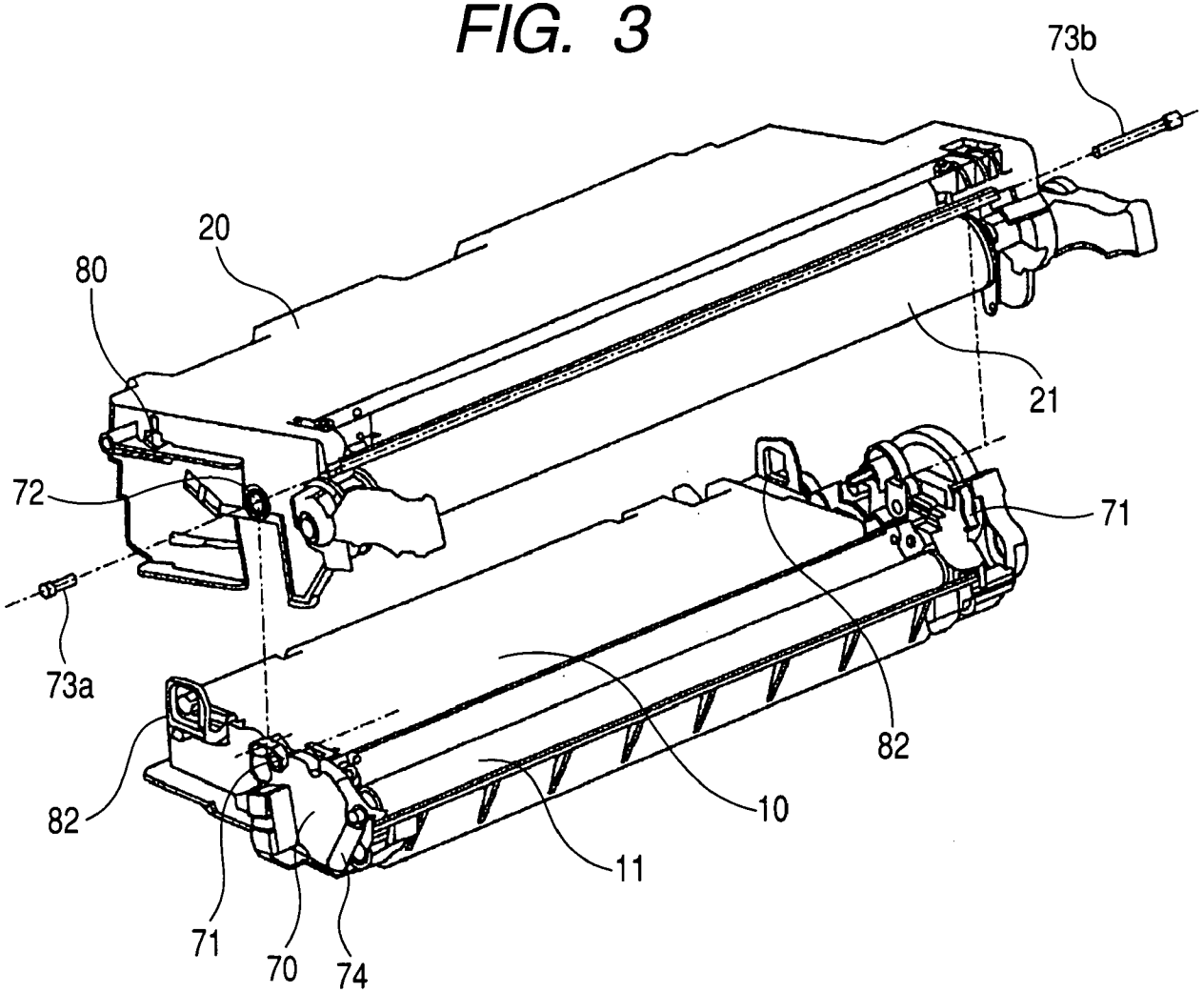
FIG. 3 is a typical perspective view of the process cartridge according to the embodiment of the present invention.

A method of supporting the developing unit will now be described with reference to FIGS. 2, 3 and 4.

The developing unit 10 has supporting holes 71 in one end and the other end thereof in the longitudinal direction thereof. The drum unit 20 also has supporting holes 72 in one end and the other end thereof in the longitudinal direction thereof. Connecting pins 73*a* and 73*b* are made to extend through the supporting holes 71 and the supporting holes 72, whereby the entire developing unit 10 is supported for rocking movement relative to the drum unit 20. The developing unit 10 is always biased by a pressure spring 74 which is biasing means so that with the supporting holes 71 and 72 as the center, the developing roller 11 may contact with the photosensitive drum 21.

[Developing Method]

During development, the toner contained in the toner container 13 is conveyed to the toner supplying roller 12 by the toner agitating mechanism 16. Then, as shown in FIG. 2, the toner supplying roller 12 frictionally contacts with the developing roller 11 to thereby supply the toner to the developing roller 11 and make the developing roller 11 carry the toner thereon. The toner carried on the developing roller 11 is then moved to the developing blade 15 with the rotation of the developing roller 11. The toner is then regulated by the developing blade 15 and a desired charge amount is imparted to the toner and also, the toner is formed into a predetermined toner layer thickness.

Then, the regulated toner is conveyed to the contact portion (developing portion) between the developing roller 11 and the photosensitive drum 21 with the rotation of the developing roller 11. Then, in the developing portion, a DC developing bias is applied from a voltage source (not shown)

to the developing roller 11. Thus, in the developing portion, the toner adheres to the electrostatic latent image formed on the surface of the photosensitive drum 21 to thereby develop the electrostatic latent image. Any toner which has not contributed to the development is conveyed by the rotation of the developing roller 11, and is collected into the developing container 14 by the frictional contact between the developing roller 11 and the toner supplying roller 12. The collected toner is agitated and mixed with the remaining toner by the toner agitating mechanism 16. In a contact developing method wherein the photosensitive drum 21 and the developing roller 11 contact with each other to thereby effect development, it is preferable that the photosensitive drum 21 be a rigid member and the developing roller 11 be a roller having an elastic material.

Figure 4A:
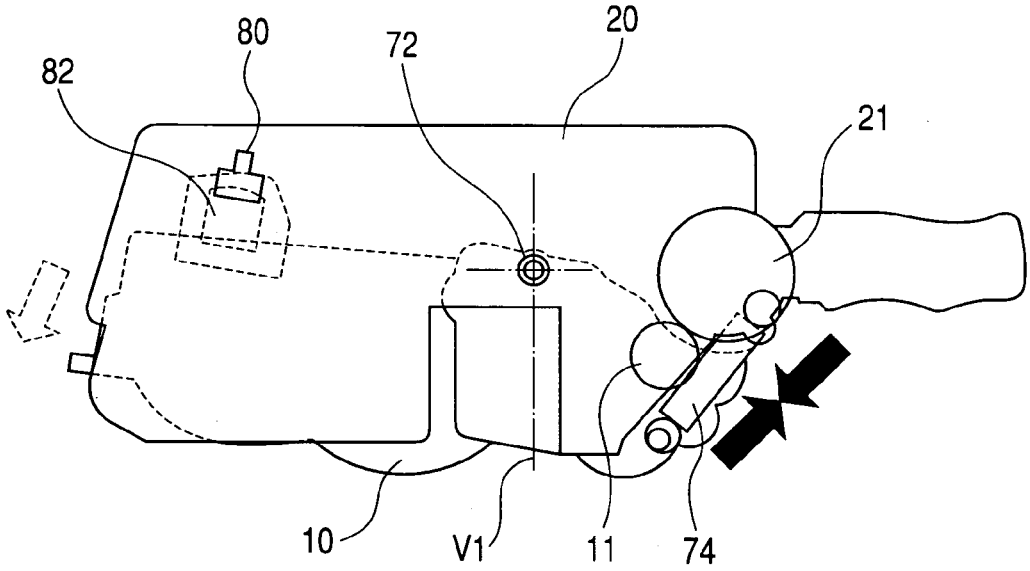
FIGS. 4A and 4B are typical views illustrating a developing contact and separating operation according to an embodiment of the present invention.
Figure 4B:
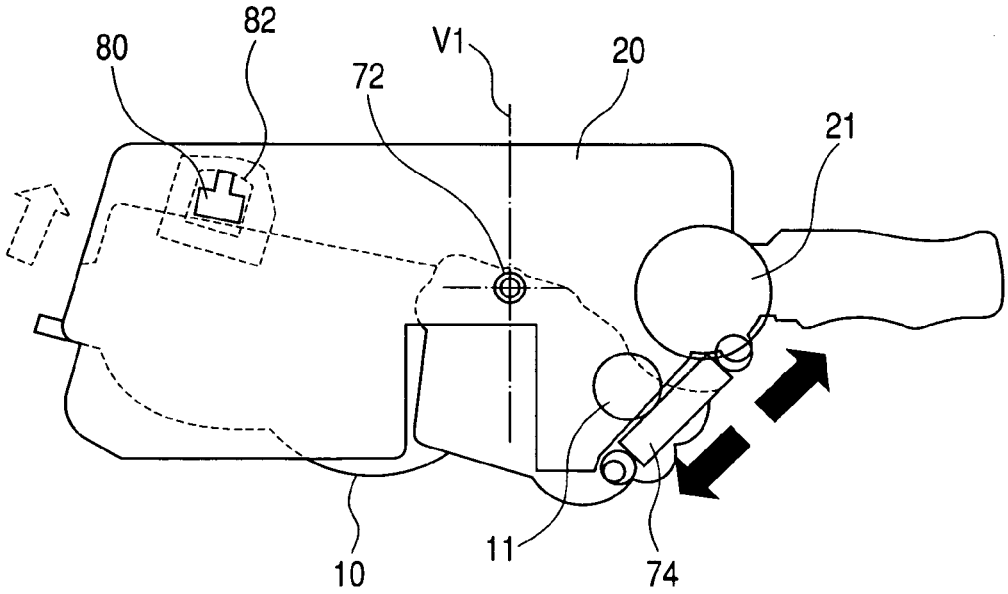
Figure 5A:
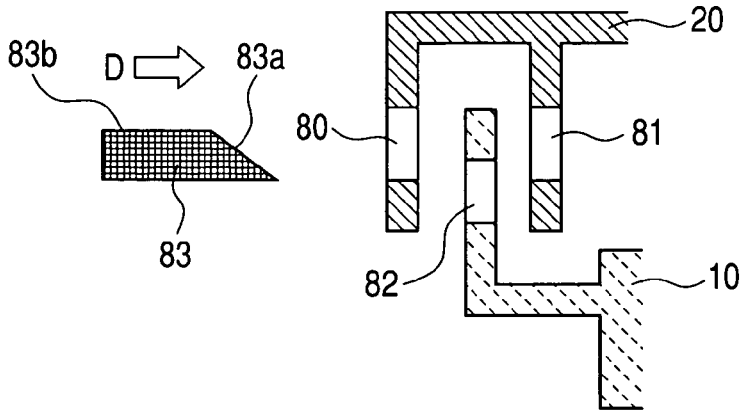
FIGS. 5A, 5B and 5C are typical views of a developing separating mechanism according to an embodiment of the present invention.
Figure 5B:
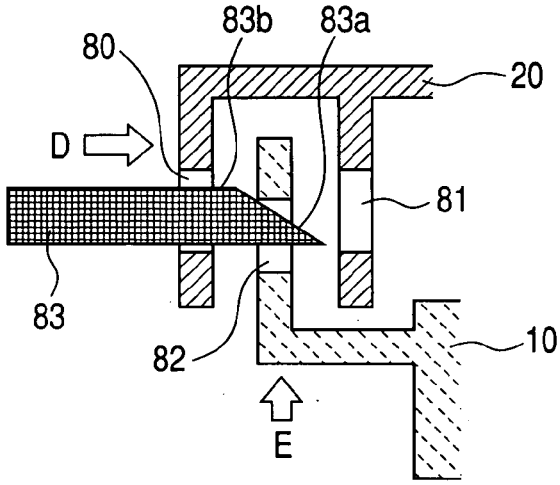
Figure 5C:
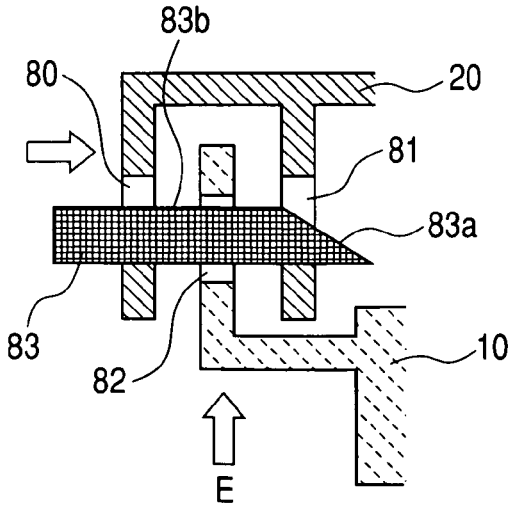
Figure 6:
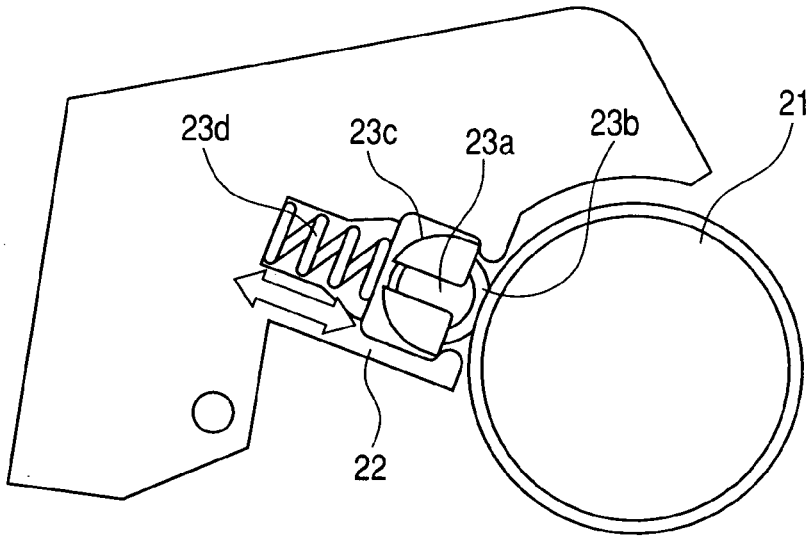
FIG. 6 is a schematic side view of a charging member according to an embodiment of the present invention.
Figure 7:
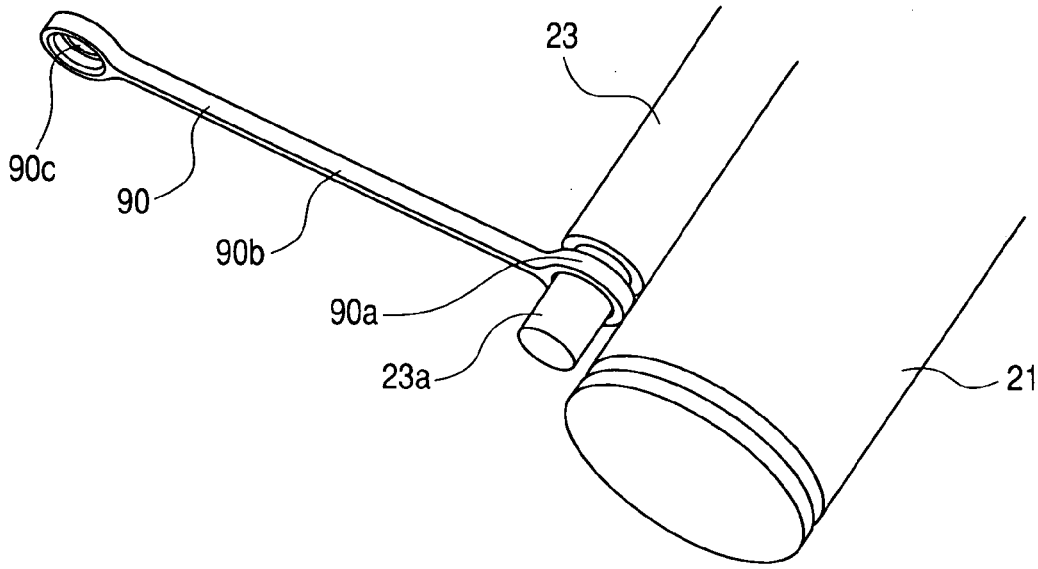
FIG. 7 is a schematic perspective view of the charging member and a charging supporting member according to an embodiment of the present invention.
Figure 8A:
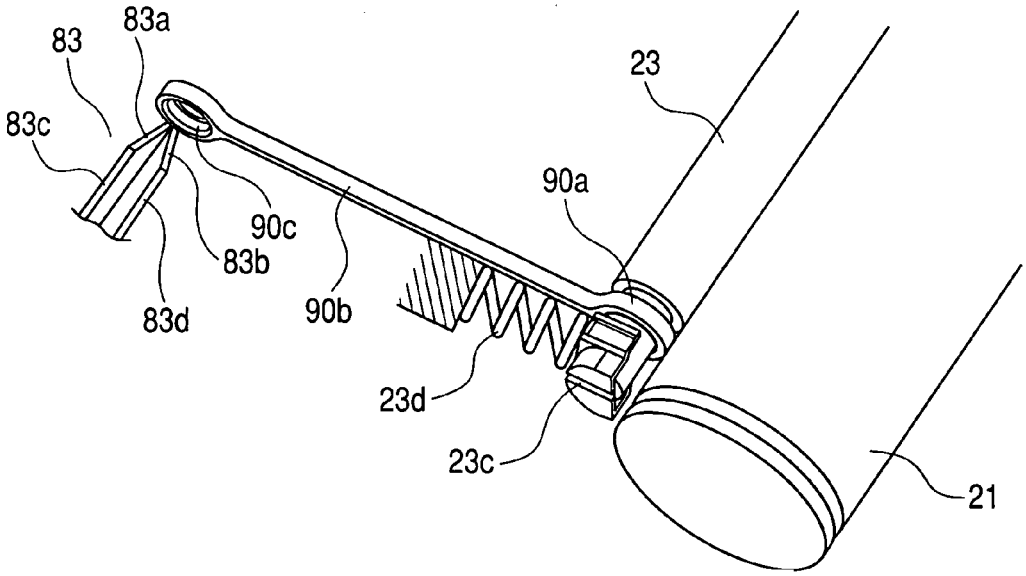
FIGS. 8A and 8B are schematic perspective views of the charging member, the charging supporting member and a charging moving member according to an embodiment of the present invention.
Figure 8B:
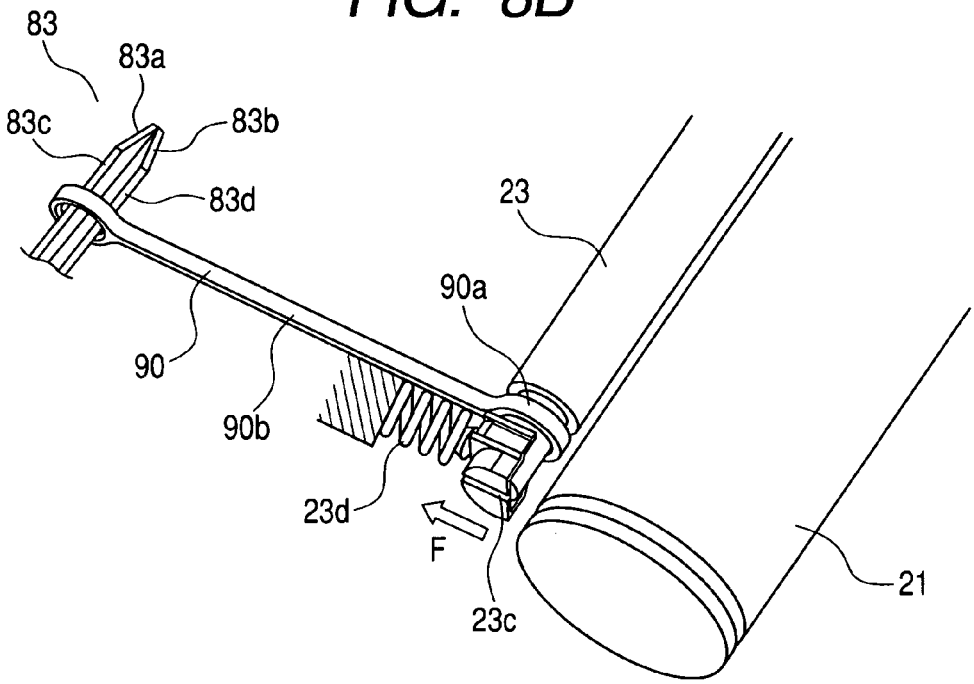

As shown in FIGS. 5A to 5C, an inclined surface 83*a* is provided on the distal end of a separating member 83 formed of a resin material in the insertion direction thereof. As shown in FIG. 5A, the separating member 83 is inserted from the direction indicated by the arrow D (the longitudinal direction of the cartridge 1) into a supporting hole 80 formed in the drum unit 20. The supporting hole 80 is provided on a side opposite to the photosensitive drum 21 with respect to a vertical line passing through the connecting pins 73*a* and 73*b*. That is, first, the separating member 83 passes through the first supporting hole 80 formed in the drum unit 20 on one end side thereof in the longitudinal direction thereof. Then, as shown in FIG. 5B, the inclined surface 83*a* comes into engagement with a third supporting hole 82 formed in the developing unit 10. When the separating member 83 is further inserted in the direction indicated by the arrow D, the developing unit 10 is raised in the direction indicated by the arrow E along the inclined surface 83*a*. Then, as shown in FIG. 5C, the developing unit 10 is raised to a position in which the configuration (engaging portion) 83*b* of the separating member 83 and the upper portion of the third supporting hole 82 are engaged with each other. That is, the inclined surface 83*a* serves to guide the supporting hole 82 to the engaging portion 83*b*. The separating member 83 is finally supported by a supporting hole 81 formed in the drum unit 20 and inside the supporting hole 80 in the longitudinal direction. That is, the separating member 83 is supported in a center impeller fashion in the first supporting hole 80 and the second supporting hole 81. In the longitudinal direction, the third supporting hole 82 formed in the developing unit 10 located between the two supporting holes is maintained moved against the biasing force of the pressure spring 74. That is, in this state, as shown in FIG. 4B, the developing roller 11 becomes separated from the photosensitive drum 21. The position of the developing unit at this time is defined as a separated position. Also, by removing the separating member 83, the third supporting hole 82 is moved by the biasing force of the pressure spring 74, and the developing roller 11 comes into contact with the photosensitive drum 21. The position of the developing unit at this time is defined as a contact position.

The aforedescribed construction of FIGS. 4A, 4B, 5A, 5B and 5C is also provided on the other end side of the cartridge 1 in the longitudinal direction thereof.

The aforedescribed construction supports the separating member 83 in a center impeller fashion in the first supporting hole 80 and the second supporting hole 81 in the longitudinal direction of the separating member 83. By adopting a construction in which the separating member comes into engagement with the developing unit 10 between the first supporting hole 80 and the second supporting hole 81 in the longitudinal direction, it is possible to suppress the deformation of the separating member 83. Accordingly, the photosensitive drum 21 and the developing roller 11 can be reliably and stably separated from each other with the lapse of time.

Figure 12A:
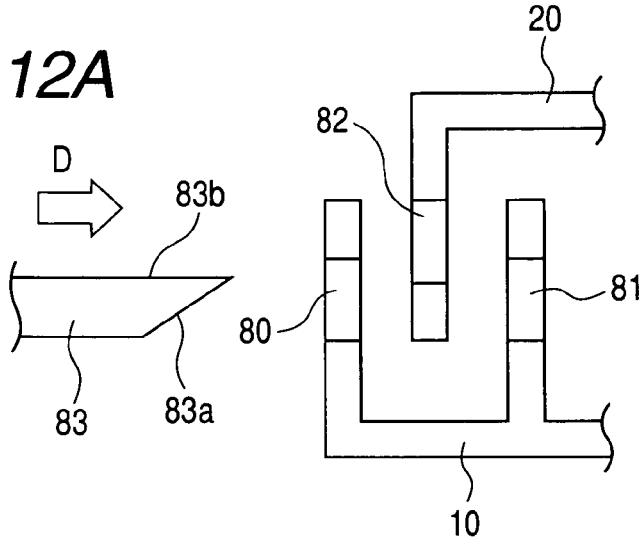
FIGS. 12A, 12B and 12C are typical views illustrating a developing contact and separating operation according to an embodiment of the present invention.
Figure 12B:
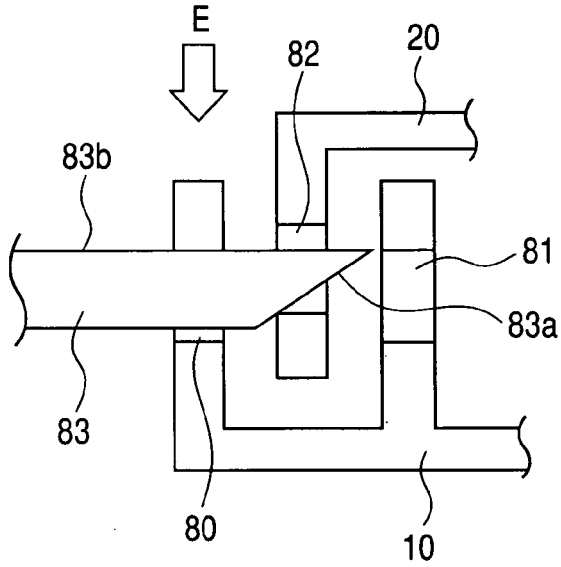
Figure 12C:
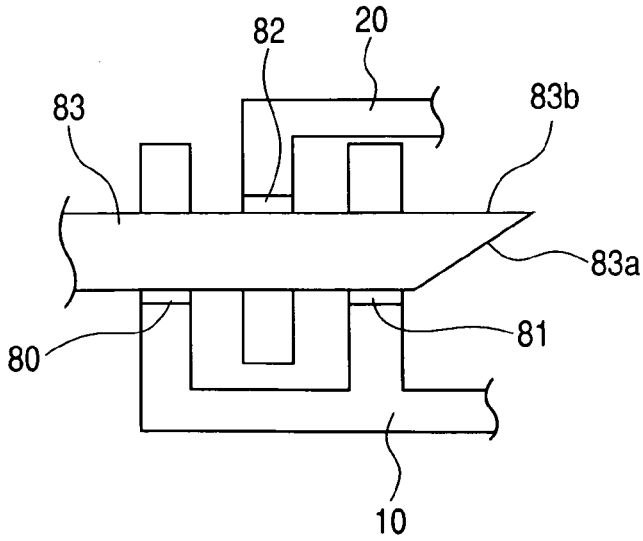

In the foregoing description, the first and second supporting holes 80 and 81 are described as being formed in the drum unit 20, and the third supporting hole 82 is described as being formed in the developing unit 10. As shown in FIGS. 12A to 12C, however, the first and second supporting holes 80 and 81 may be formed in the developing unit 10, and the third supporting hole 82 may be formed in the drum unit 20.

As shown in FIG. 12A, the separating member 83 is inserted from the direction indicated by the arrow D (the longitudinal direction of the cartridge 1) into the developing unit 10. That is, first, the separating member 83 passes through the first supporting hole 80 formed in the drum unit 20 on one end side thereof in the longitudinal direction thereof. Next, as shown in FIG. 12B, the inclined surface 83*a* comes into engagement with the third supporting hole 82 formed in the developing unit 10. It should be noted that the inclined surface 83*a* is opposite in a vertical direction to that in the embodiment shown in FIG. 5B. That is, the separating member 83 is inserted in a position wherein the inclined surface 83*b* faces downwardly. When the separating member 83 is further inserted into the developing unit 10 in the direction indicated by the arrow D, the drum unit 20 lowers in the direction indicated by the arrow E along the inclined surface 83*a*. Then, as shown in FIG. 12C, the drum unit 20 lowers to a position in which the outer diameter portion of the separating member 83 and the lower portion of the third supporting hole 82 are engaged with each other. Thus, the separating member 83 is finally supported by the supporting hole 81 formed in the drum unit 20 inside the supporting hole 80 in the longitudinal direction. That is, the separating member 83 is supported in a center impeller fashion in the first supporting hole 80 and the second supporting hole 81. Then, the third supporting hole 82 formed in the developing unit 10 located between the two supporting holes in the longitudinal direction is maintained moved against the biasing force of the pressure spring 74. That is, in this state, as shown in FIG. 4B, the developing roller 11 becomes separated from the photosensitive drum 21. The position of the developing unit at this time is defined as a separated position. Also, by removing the separating member 83, the third supporting hole is moved by the biasing force of the pressure spring 74, and as shown in FIG. 4A, the developing roller 11 comes into contact with the photosensitive drum 21. The position of the developing unit at this time is defined as a contact position.

The aforedescribed construction shown in FIGS. 12A to 12C is also provided on the other end side of the cartridge 1 in the longitudinal direction thereof.

That is, there is obtained an effect similar to the effect of the aforedescribed construction shown in FIGS. 4A, 4B and 5A to 5C.

[Grip Portions]

Figure 11A:
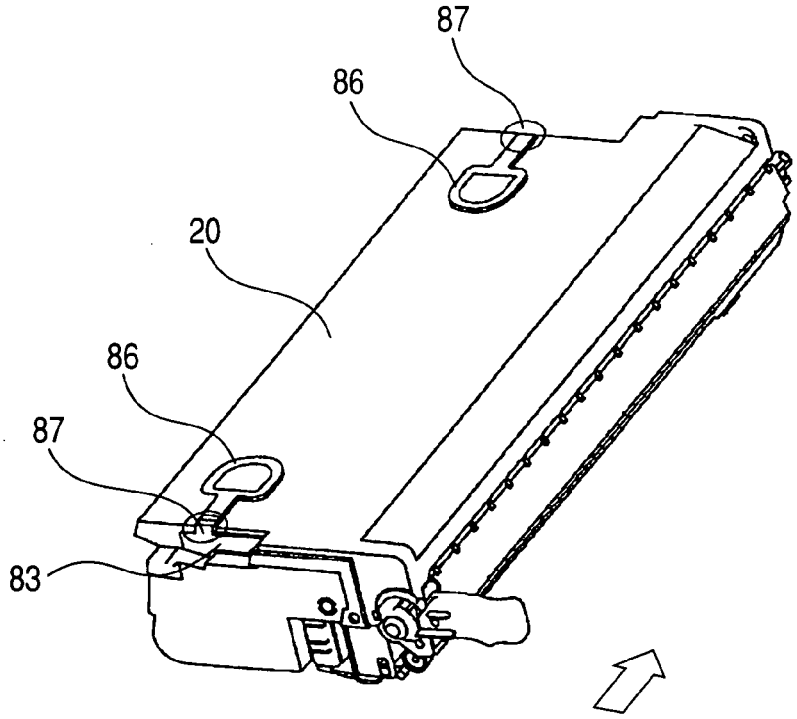
FIGS. 11A and 11B are schematic views of the process cartridge during the unsealing of the toner seal according to the embodiment of the present invention.
Figure 11B:
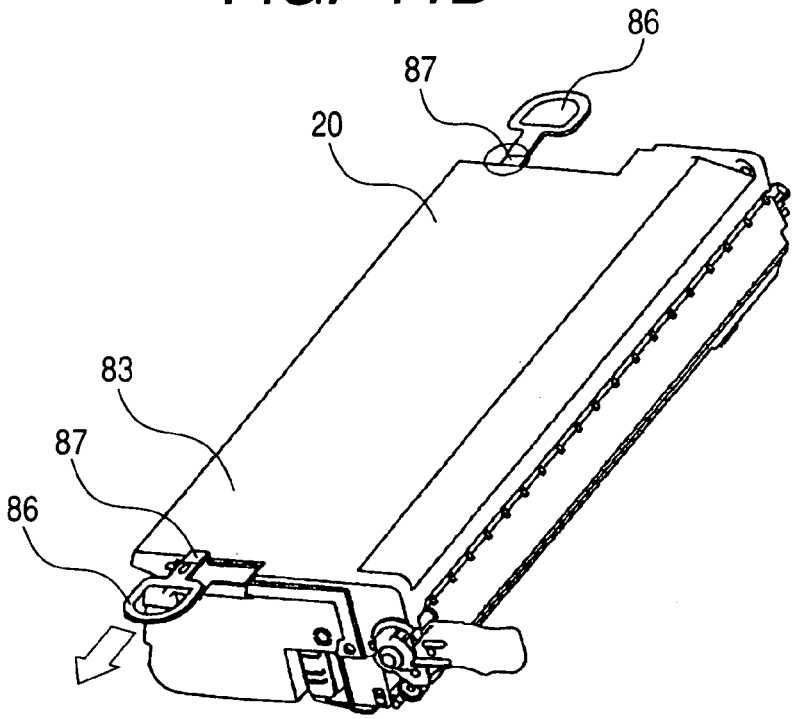

The construction of grip portions 86 provided on the separating member 83 will now be described with reference to FIGS. 11A and 11B. The separating member 83 is provided with the grip portions 86 so that it may be easy for the user to apply a force when he pulls out the separating member 83. As shown in FIG. 11A, the grip portions 86 can be bent at bent positions 87 along the longitudinal direction of the cartridge 1 (here the drum unit 20). The cartridge 1 with the separating member 83 remaining mounted thereon can be mounted on the image forming apparatus 100. Therefore, with the cartridge 1 remaining mounted on the image forming apparatus 100, the developing roller 11 and the photosensitive drum 21 can be separated from each other. The user, when he pulls out the separating member 83, can bend the grip portion 86 in the pull-out direction at the bent portion 87, as shown in FIG. 11B.

Embodiment 2

A second embodiment of the present invention will now be described with reference to FIGS. 6 to 9, 13A to 13E and 14A to 14B.

This embodiment is of a construction in which by the separating member 83, the photosensitive drum 21 and the charging roller 23 are separated from each other simultaneously with the separation of the developing roller 11 from the photosensitive drum 21.

[Charging Roller]

The charging roller 23 uses a contact charging method, and is brought into contact with the surface of the photosensitive drum 21 and a voltage is applied to the charging roller 23, whereby the charging roller 23 uniformly charges the surface of the photosensitive drum 21. The charging roller 23 is constituted by a mandrel 23*a* having an electrically conductive rubber member 23*b* formed around it. The charging roller 23 is urged against the photosensitive drum 21 by a pressure spring (biasing means) 23*d* through a charging bearing 23*c*. The charging roller 23 is rotatably supported by the charging bearing 23*c*. Further, the charging bearing 23*c* is supported by a guide portion 22. A charging member bearing 131 and a guide portion 133 are slidable relative to each other. The charging roller 23 is rotatable and is movable in the direction indicated by the arrow in FIG. 6 (a direction toward and away from the photosensitive drum 21).

[Supporting Member]

A supporting member 90 is formed by a bearing portion 90*a*, a connecting portion 90*b* and an action hole portion 90*c*, and the bearing portion 90*a* can slidably support the charging member mandrel 23*a*. The bearing portion 90*a* is adapted not to contact the photosensitive drum 21 and thus, does not injure the surface of the photosensitive drum 21. The separating member 83 is inserted into the action hole portion 90*c* of the supporting member 90 to thereby move the supporting member 90 and separate the charging roller 23 from the photosensitive drum 21. The separating member 83, as in Embodiment 1, is inserted through the first supporting hole 80 formed in the drum unit 20.

[Separating Member]

Figure 9:
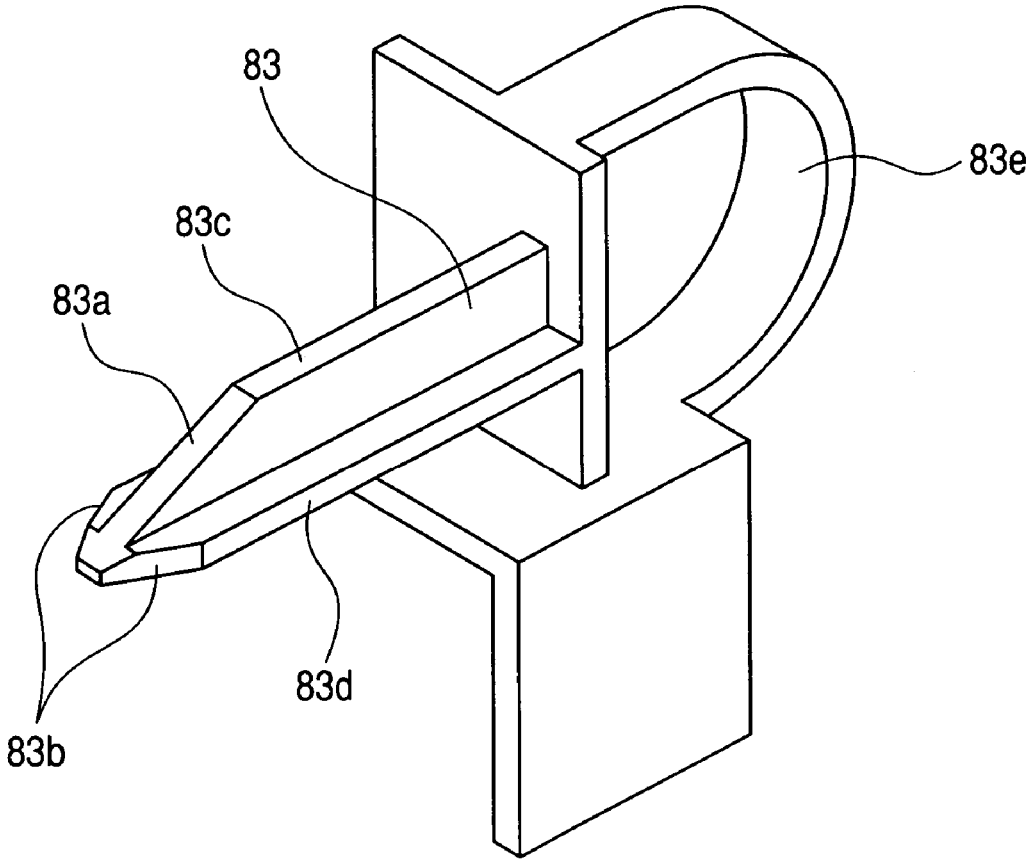
FIG. 9 is a schematic perspective view of a separating member according to an embodiment of the present invention.

As shown in FIG. 9, the separating member 83 in the present embodiment is also formed of a resin material. The separating member 83 has a first inclined surface 83*a*, a second inclined surface 83*b*, a first engaging portion 83*c* and a second engaging portion 83*d*. The first inclined surface 83*a* is provided to come into engagement with the third supporting hole 82 to thereby guide the developing unit 10 to the separated position when the separating member 83 is inserted into the cartridge 1. Also, the second inclined surface 83*b* is provided to come into engagement with the action hole portion 90*c* of the supporting member 90 to thereby guide the charging roller 23 to a position in which it is separated from the photosensitive drum 21 when the separating member 83 is inserted into the cartridge 1. Also, the reference character 83*e* designates a grip portion to be gripped by the operator when the separating member 83 is inserted into the cartridge 1.

[Separation of the Developing Roller and the Charging Roller]

A construction for moving the developing roller and the charging roller will now be described with reference to FIGS. 7 to 9, 13A to 13E and 14A and 14B.

The operation of separating the developing roller 11 and the charging roller 23 will now be described.

Figure 13A:
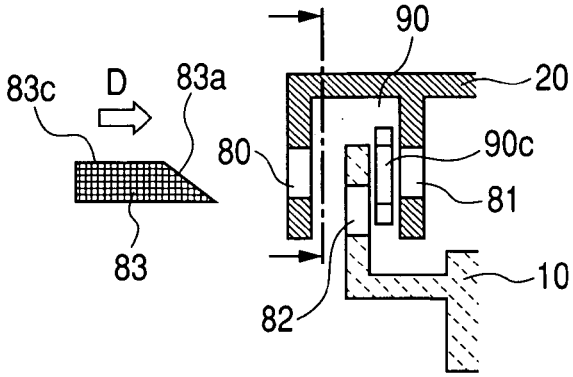
FIGS. 13A, 13B, 13C, 13D and 13E are typical views illustrating the developing contact and separating operation according to the embodiment of the present invention.
Figure 13B:
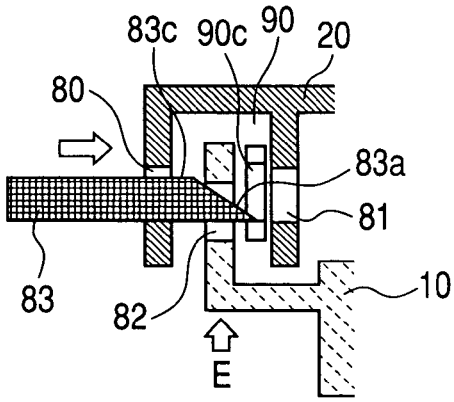
Figure 13C:
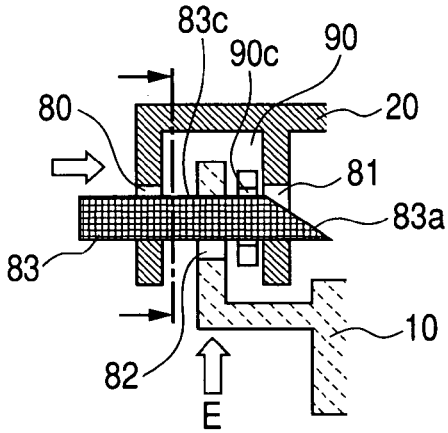
Figure 13D:
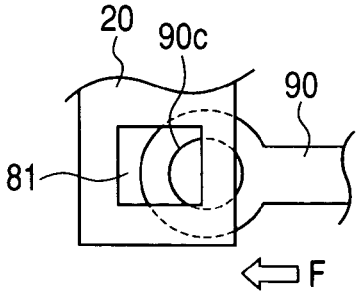

First, as shown in FIG. 13A, the separating member 83 is inserted in the direction indicated by the arrow D (the longitudinal direction of the cartridge 1). That is, the separating member 83 passes through the first supporting hole 80 formed in the drum unit 20 at one end thereof in the longitudinal direction thereof. Next, as shown in FIG. 13B, the inclined surface 83*a* comes into engagement with the third supporting hole 82 formed in the developing unit 10. When the separating member 83 is further inserted in the direction indicated by the arrow D, the developing unit 10 is raised in the direction indicated by the arrow E along the inclined surface 83*a*. Then, as shown in FIG. 13C, the developing unit 10 is raised to a position in which the first engaging portion 83*c* and the upper portion of the second supporting hole 2 are engaged with each other. That is, the developing unit 10 is moved to the separated position. Next, as shown in FIG. 13D, the separating member 83 and the action hole portion 90*c* starts engagement with each other. That is, the second inclined surface 83*b* comes into engagement with the action hole portion 90*c* to thereby further insert the separating member 83 in the direction indicated by the arrow D. Thereupon, the connecting portion 90*b* is moved in the direction indicated by the arrow F along the inclined surface 83*b*. Here, the direction indicated by the arrow E is a direction intersecting with the direction indicated by the arrow F, and in the present embodiment, a direction substantially orthogonal to the latter. When the separating member 83 is further moved in the direction indicated by the arrow D, the action hole portion 90*c* is moved to a position in which it comes into engagement with the second engaging portion 83*d*. In this state, the charging roller 23 becomes separated from the photosensitive drum 21. The position of the connecting portion 90*b* at this time is defined as a separated position (a second separated position). The position of the connecting portion 90*b* when the charging roller 23 is in contact with the photosensitive drum 21 is defined as a contact position (a second contact position). The separating member 83 is finally supported by the supporting hole 81 formed in the drum unit 20 inside the supporting hole 80 in the longitudinal direction. In a state shown in FIG. 13E, simultaneously with the separation of the developing roller 11 from the photosensitive drum 21, the charging roller 23 is also maintained separated from the photosensitive drum 21. That is, the developing roller 11 and the charging roller 23 differing in the direction in which they are separated from the photosensitive drum 21 can be separated from the photosensitive drum at a time by the separating member 83.

Figure 13E:
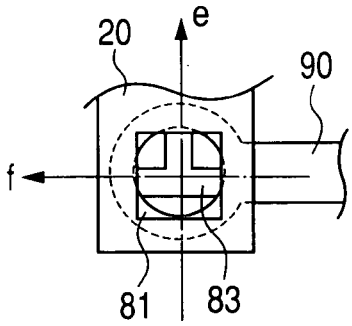
Figure 14A:
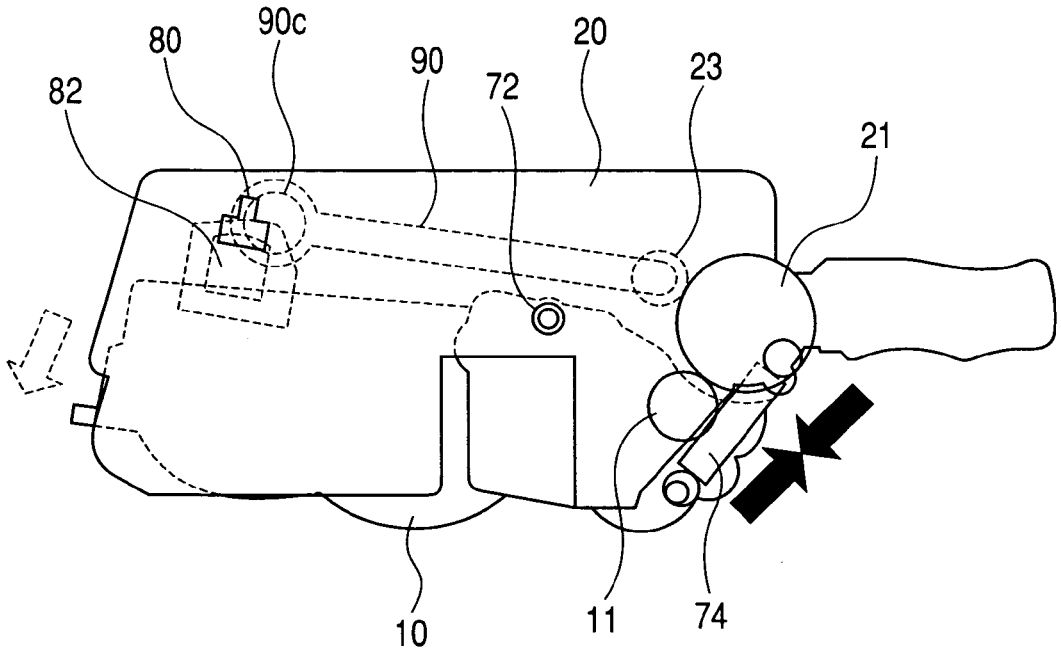
FIGS. 14A and 14B are typical views illustrating the developing contact and separating operation according to the embodiment of the present invention.
Figure 14B:
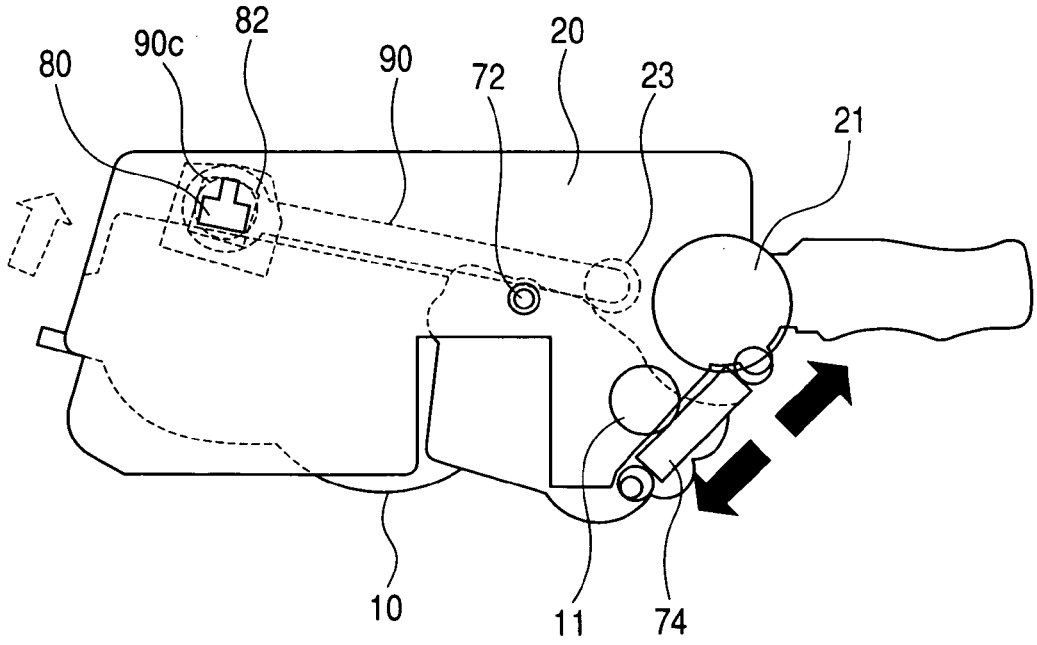

That is, in the longitudinal direction of the separating member 83, the separating member 83 is supported in a center impeller fashion in the first supporting hole 80 and the second supporting hole 81 in both of a direction e and a direction f, as shown in FIG. 13E. By adopting a construction in which the separating member 83 is engaged with the developing unit 10 and the connecting portion 90*b* between the first supporting hole 80 and the second supporting hole 81 in the longitudinal direction, it is possible to suppress the deformation of the separating member 83. Accordingly, it is possible to reliably and stably separate the photosensitive drum 21 and the developing roller 11 from each other and separate the photosensitive drum 21 and the charging roller 23 from each other with the lapse of time.

Also, with regard to the other end side in the longitudinal direction, the separating roller 23 is separated by a similar construction and the pressure applied to the charging member is released. As described above, because of a mechanism which is not made to act directly on the charging roller 23, but acts on the charging member through the supporting member supporting the charging member, it becomes unnecessary to make any special design such as forming an insertion hole in the frame around the charging member which requires accuracy and rigidity.

Also, the separating member 83 is designed to be detachably mountable on the process cartridge 1 and therefore, when image forming is not carried out for a long period, the separating member 83 can be mounted on the process cartridge 1 to thereby separate the developing roller 11 and the charging roller 23 again from the photosensitive drum.

The aforedescribed construction shown in FIGS. 6 to 9, 13A to 13E and 14A and 14B is also provided on the other end side of the cartridge 1 in the longitudinal direction thereof.

Embodiment 3

A third embodiment of the present invention will now be described with reference to FIGS. 2 and 10A to 10C.

[Toner Seal]

The toner container 13 and the developing container 14 have the opening portion 17 thereof closed by a toner seal 85 which is a seal member before the start of use such as shipping so as not to cause the leakage of the toner. When the cartridge 1 is used, the toner seal 85 is unsealed, whereby the opening portion 17 is opened, and the toner in the toner container 13 can be moved into the developing container 14 by the conveying member 16.

Figure 10A:
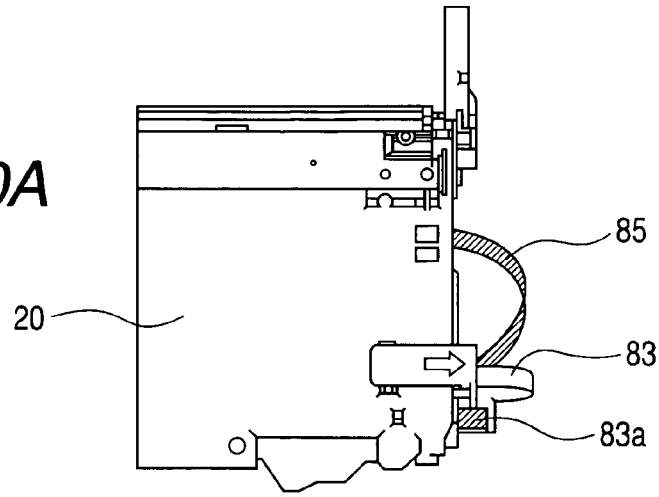
FIGS. 10A, 10B and 10C are schematic views of the process cartridge during the unsealing of a toner seal according to an embodiment of the present invention.
Figure 10B:
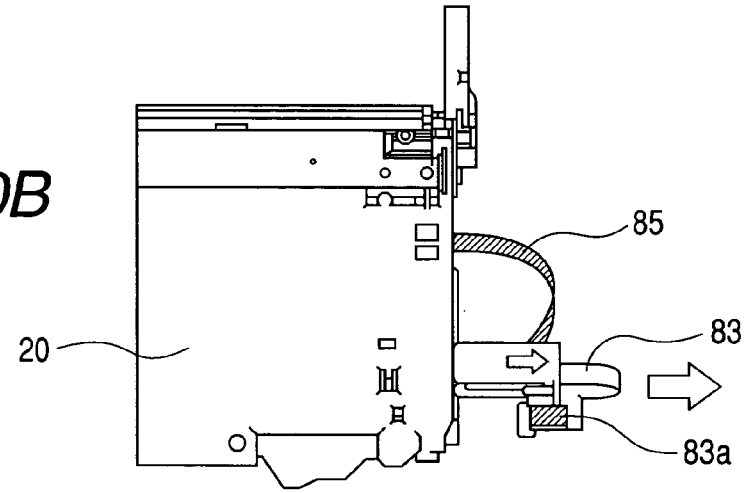
Figure 10C:
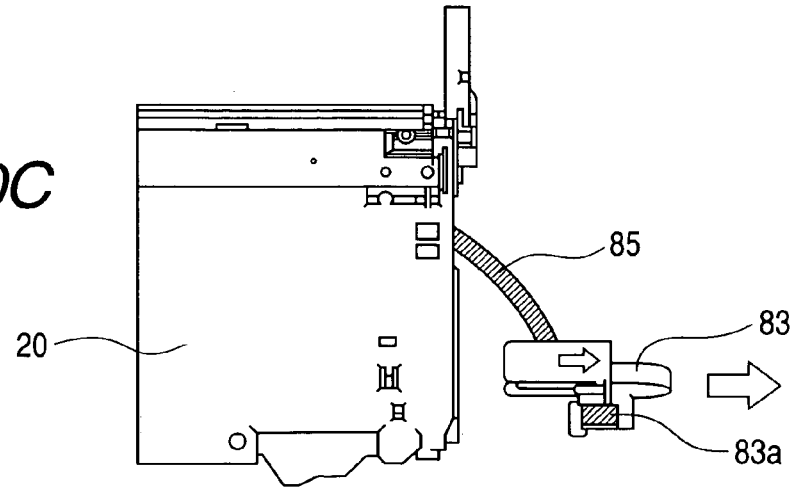

The construction of the present embodiment is substantially the same as that of Embodiment 2, but as shown in FIGS. 10A to 10C, an end portion of the toner seal 85 is further attached to the toner seal attaching surface 83*a* of the separating member 83. By adopting such a construction, when the user unseals the toner seal 85, the separation of the developing roller 11 from the photosensitive drum 21 and the separation of the charging roller 23 from the photosensitive drum 21 can be effected at a time. Accordingly, forgetting to pull out the separating member 83 can be prevented by a simple construction.

The present invention is not restricted to the above-described embodiments. Other forms and disposition of constituent factors than those in the embodiments are also possible, but are confined within the effective scope of the present invention.

As described above, according to the present invention, the separating member for separating the developing roller and the electrophotographic photosensitive drum from each other can be reliably supported by the first frame and the second frame and therefore, the separation of the developing roller from the electrophotographic photosensitive drum can be effected stably and reliably.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application No. 2005-129494 filed on Apr. 27, 2005, which is hereby incorporated by reference herein.

What is claimed is:

1. A process cartridge detachably mountable on a main body of an electrophotographic image forming apparatus, said process cartridge comprising:

an electrophotographic photosensitive drum;

a developing roller configured and positioned to contact said electrophotographic photosensitive drum to develop an electrostatic latent image formed on said electrophotographic photosensitive drum;

a first frame configured and positioned to rotatably support said electrophotographic photosensitive drum;

a second frame configured and positioned to rotatably support said developing roller, said second frame being rotatably connected to said first frame to assume a contact position in which said developing roller contacts said electrophotographic photosensitive drum, and a separated position in which said developing roller is separated from said electrophotographic photosensitive drum; and a separating member configured and positioned to hold said second frame in the separated position when said separating member is in engagement with said first frame and said second frame from a longitudinal direction of said process cartridge, wherein said separating member is engaged with a first supporting portion and a second supporting portion provided in said first frame, and a third supporting portion provided in said second frame and located between said first supporting portion and said second supporting portion in said longitudinal direction.

2. A process cartridge detachably mountable on a main body of an electrophotographic image forming apparatus, said process cartridge comprising:

an electrophotographic photosensitive drum;

a developing roller configured and positioned to contact said electrophotographic photosensitive drum to develop an electrostatic latent image formed on said electrophotographic photosensitive drum;

a first frame configured and positioned to rotatably support said electrophotographic photosensitive drum;

a second frame configured and positioned to rotatably support said developing roller, said second frame being rotatably connected to said first frame to assume a contact position in which said developing roller contacts with said electrophotographic photosensitive drum, and a separated position in which said developing roller is separated from said electrophotographic photosensitive drum; and a separating member configured and positioned to hold said second frame in the separated position when said separating member is in engagement with said first frame and said second frame from a longitudinal direction of said process cartridge, wherein said separating member is engaged with a first supporting portion and a second supporting portion provided in said second frame, and a third supporting portion provided in said first frame and located between said first supporting portion and said second supporting portion in said longitudinal direction.

3. A process cartridge according to claim 1 or 2, wherein said first supporting portion, said second supporting portion and said third supporting portion are holes.

4. A process cartridge according to claim 1 or 2, wherein said first supporting portion, said second supporting portion and said third supporting portion are provided on a side of said process cartridge opposite to said electrophotographic photosensitive drum with respect to a vertical line passing through a rotation center rotatably connecting said first frame and said second frame to each other.

5. A process cartridge according to claim 1 or 2, wherein said separating member is detachably engaged on each of one end side and the other end side of said first frame and said second frame in said longitudinal direction.

6. A process cartridge according to claim 1 or 2, wherein said separating member has an inclined surface on a distal end side of said separating member when said separating member is mounted on said first frame and said second frame.

7. A process cartridge according to claim 1 or 2, further comprising:

a developer containing portion containing a developer configured and positioned to develop the electrostatic latent image formed on said electrophotographic photosensitive drum, and having an opening for supplying the developer from said developer containing portion to said developing roller; and a seal member detachably closing the opening, one end side of said seal member in a longitudinal direction of said seal member being connected to said separating member.

8. A process cartridge according to claim 1 or 2, further comprising:

a charging roller configured and positioned to contact said electrophotographic photosensitive drum to charge said electrophotographic photosensitive drum; and a supporting member rotatably supporting said charging roller to assume a second contact position in which said charging roller contacts said electrophotographic photosensitive drum, and a second separated position in which said charging roller is separated from said electrophotographic photosensitive drum, and having a fourth supporting portion engaged with said separating member to hold said supporting member in said second separated position.

9. A process cartridge according to claim 8, wherein said supporting member is engaged with said separating member between said first supporting portion and said second supporting portion in said longitudinal direction.

10. An electrophotographic image forming apparatus for forming an image on a recording medium, said electrophotographic image forming apparatus comprising:

(i) a process cartridge having an electrophotographic photosensitive drum, a developing roller configured and positioned to contact said electrophotographic photosensitive drum to develop an electrostatic latent image formed on said electrophotographic photosensitive drum, a first frame configured and positioned to rotatably support said electrophotographic photosensitive drum, a second frame configured and positioned to rotatably support said developing roller, said second frame being rotatably connected to said first frame to assume a contact position in which said developing roller contacts said electrophotographic photosensitive drum, and a separated position in which said developing roller is separated from said electrophotographic photosensitive drum, and a separating member configured and positioned to hold said second frame in the separated position when said separating member is in engagement with said first frame and said second frame from a longitudinal direction of said process cartridge, wherein said separating member is engaged with a first supporting portion and a second supporting portion provided in said first frame, and a third supporting portion provided in said second frame and located between said first supporting portion and said second supporting portion in the longitudinal direction;

(ii) conveying means for conveying the recording medium; and (iii) a mounting member configured and positioned to detachably mount said process cartridge.

11. An electrophotographic image forming apparatus for forming an image on a recording medium, said electrophotographic image forming apparatus comprising:

(i) a process cartridge having an electrophotographic photosensitive drum, a developing roller configured and positioned to contact said electrophotographic photosensitive drum to develop an electrostatic latent image formed on said electrophotographic photosensitive drum, a first frame configured and positioned to rotatably support said electrophotographic photosensitive drum, a second frame configured and positioned to rotatably support said developing roller, said second frame being rotatably connected to said first frame to assume a contact position in which said developing roller contacts said electrophotographic photosensitive drum, and a separated position in which said developing roller is separated from said electrophotographic photosensitive drum, and a separating member configured and positioned to hold said second frame in the separated position when said separating member is in engagement with said first frame and said second frame from a longitudinal direction of said process cartridge, said separating member being engaged with a first supporting portion and a second supporting portion provided in said second frame, and a third supporting portion provided in said first frame and located between said first supporting portion and said second supporting portion in the longitudinal direction;

(ii) conveying means for conveying the recording medium; and (iii) a mounting member configured and positioned to detachably mount said process cartridge.

* * * * *

UNITED STATES PATENT AND TRADEMARK OFFICE

CERTIFICATE OF CORRECTION

PATENT NO. : 7,272,339 B2
APPLICATION NO. : 11/137577
DATED : September 18, 2007
INVENTOR(S) : Masatomo Tsuzuki et al.

It is certified that error appears in the above-identified patent and that said Letters Patent is hereby corrected as shown below:

ON THE TITLE PAGE

At Item (56), References Cited, Foreign Patent Documents, "05188667" should read --05-188667--; "2001201914" should read --2001-201914; and "11015354" should read --11-015354--.

Signed and Sealed this

Twenty-seventh Day of January, 2009

JOHN DOLL
*Acting Director of the United States Patent and Trademark Office*